US005860628A

United States Patent [19]

Miani et al.

[11] Patent Number: 5,860,628

[45] Date of Patent: Jan. 19, 1999

[54] HANGER FOR SUPPORTING LIGHT FIXTURES ON A WALL-MOUNTED POWER TRACK

[75] Inventors: Thomas Miani, Haverhill, Mass.; Kristen Bandle, Limerick, Me.

[73] Assignee: Boston Metal Products Corp., Medford, Mass.

[21] Appl. No.: 526,509

[22] Filed: Sep. 11, 1995

[51] Int. Cl.[6] ..... F21V 21/14

[52] U.S. Cl. ..... 248/223.41; 248/246; 248/297.21; 362/147; 362/250

[58] Field of Search ..... 248/223.41, 225.11, 248/244, 245, 246, 297.21, 298.1; 362/250, 147, 389, 404

[56] References Cited

U.S. PATENT DOCUMENTS

| | | | |
|---|---|---|---|
| 3,429,540 | 2/1969 | Worrallo | 248/246 |
| 4,170,335 | 10/1979 | King | 248/297.21 X |
| 4,299,368 | 11/1981 | Winkler | 248/246 |
| 4,538,784 | 9/1985 | O'Flanagan | 248/244 |
| 4,593,824 | 6/1986 | Pfeifer | 248/223.41 X |
| 4,747,025 | 5/1988 | Barton | 362/147 |
| 4,911,393 | 3/1990 | Alperson | 248/246 |
| 4,938,444 | 7/1990 | Worrallo | 248/244 X |
| 5,154,385 | 10/1992 | Lindberg et al. | 248/225.11 |

*Primary Examiner*—Derek J. Berger
*Attorney, Agent, or Firm*—Hale and Dorr LLP

[57] ABSTRACT

A hanger for holding light fixtures on a power track has a rubber block with appropriate size, shape, and material to create sufficient frictional force relative to a wall to prevent the hanger from sliding under the combined weight of the hanger and the fixture.

19 Claims, 5 Drawing Sheets

HANGER FOR SUPPORTING LIGHT FIXTURES ON A WALL-MOUNTED POWER TRACK

FIELD OF THE INVENTION

This invention relates to a hanger for holding light fixtures along a power track.

BACKGROUND OF THE INVENTION

In stores that sell light fixtures, hangers can be used to support the fixtures in a power track so that the fixtures can be easily moved or replaced as desired. One type of hanger is elongated and fits into a power track that is on a wall or a ceiling. The hanger has an opening through which a power cord extends from the fixture to the rear of the hanger and along the power track to an outlet. While this hanger works well for ceiling-mounted fixtures, it does not work well with wall-mounted fixtures because the hanger can slide down the power track under the weight of the fixture.

SUMMARY OF THE INVENTION

The invention is an improved hanger for supporting a light fixture. As in the prior art, the hanger can be mounted on a power track that is on a ceiling or on a wall. The improved hanger, however, has a block that serves as a brake and prevents the hanger from moving relative to the track on which it is mounted. When the power track is rigidly mounted on the wall, the block extends the depth of the power track to contact the rear of the power track (or the wall if the track rear is open) and provides sufficient frictional force so that the hanger does not slide down the power track. In a preferred embodiment, the block is rectangular, is made of rubber, and is mounted to a rear side of the hanger with dual-sided mounting tape. If the block is mounted at an end of the hanger along which a power cord extends, the block can be provided with a bore for receiving the power cord extends. Other shapes and materials can be used for the block, as long as the block provides sufficient frictional force between the block and the rear wall of the track to prevent sliding of the hanger. Other means for mounting the block to the hanger can be used, including epoxies or a rigid mechanical retainer, such as a clamp or pins.

The hanger of the present invention provides an easy and convenient way to display both ceiling-mounted fixtures and wall-mounted fixtures on a power track. The block can be easily retrofitted to an existing hanger or can be manufactured with the hanger. Other features and advantages will become apparent from the following detailed description when read in conjunction with the drawings, and from the appended claims.

DETAILED DESCRIPTION

Figure 1:
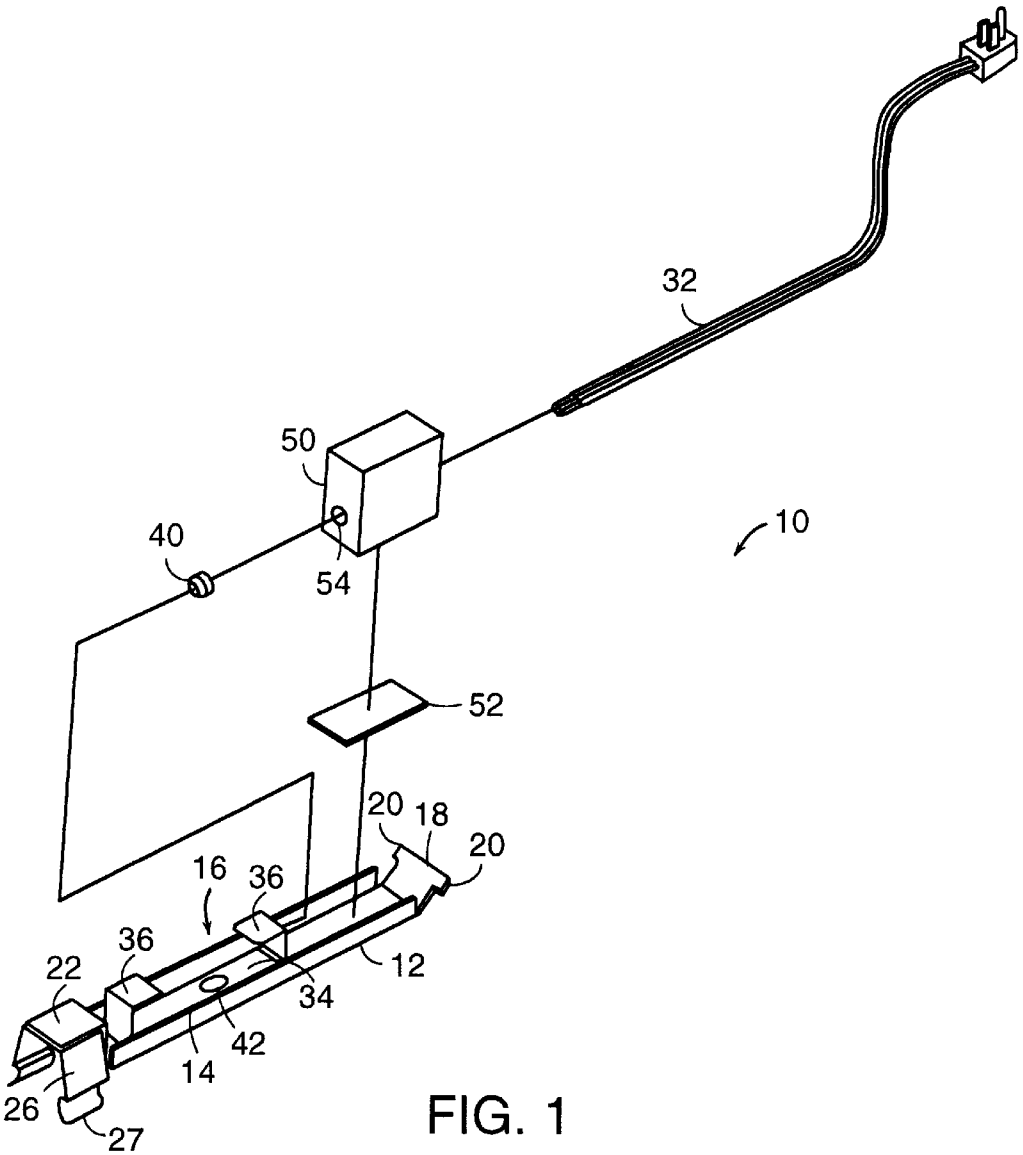
FIG. 1 is an exploded perspective view of a hanger according to a first embodiment of the present invention.

A first embodiment of the present invention is illustrated in FIGS. 1–4. A hanger 10 has an elongated member 12 with upturned sides 14 that form an elongated channel 16. At one end of the hanger is an integral, angled, upturned portion 18 with lateral tabs 20. At the other end of member 12 is an integral dog-leg shaped support 22 with one portion in channel 16 and another portion coupled with a rivet (not shown) to a generally C-shaped compression spring 26.

Figure 3:
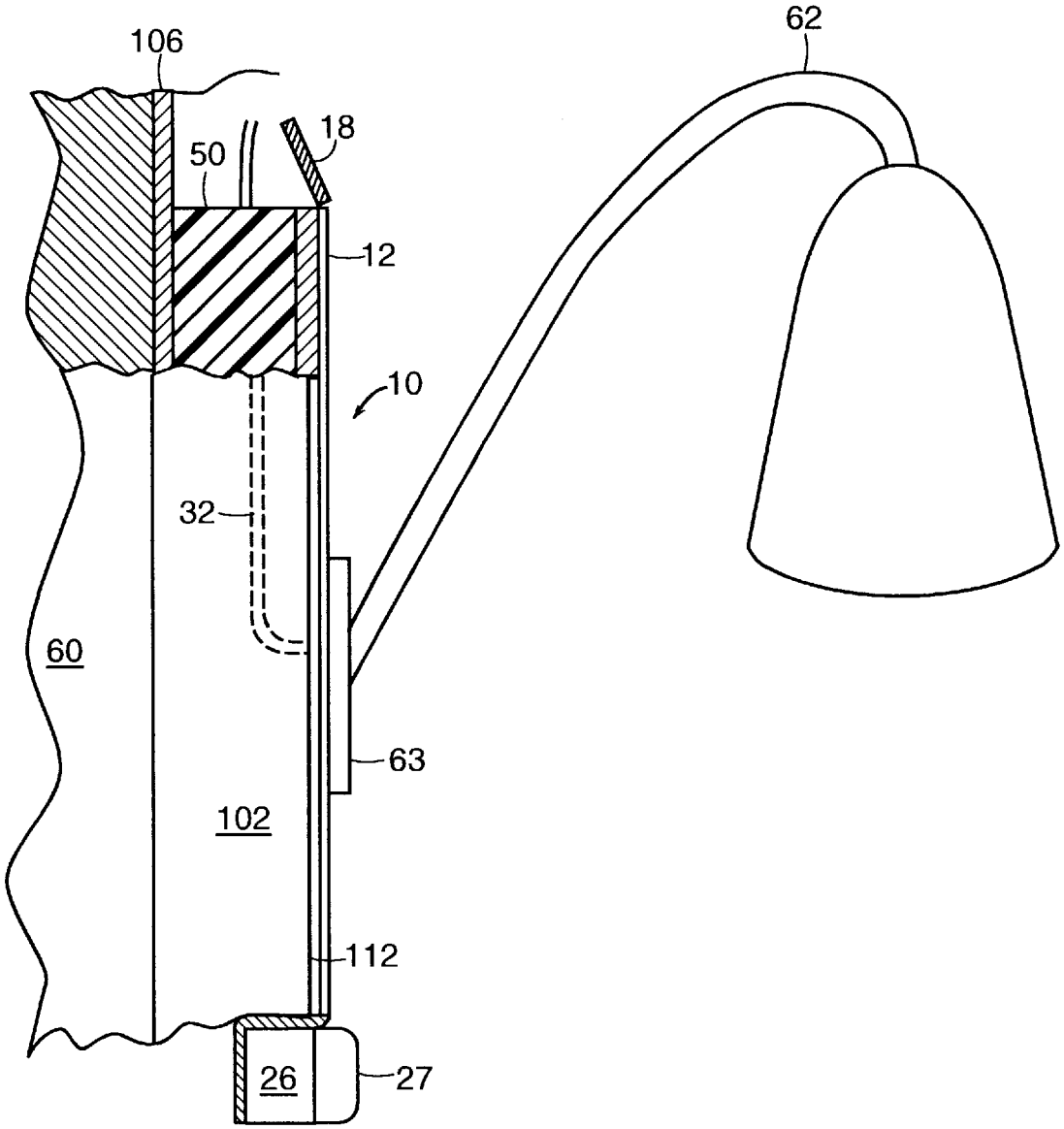
FIG. 3 is a partially cut-away and partially cross-sectional side view of the hanger of FIG. 1, shown in a power track against a wall.
Figure 4:
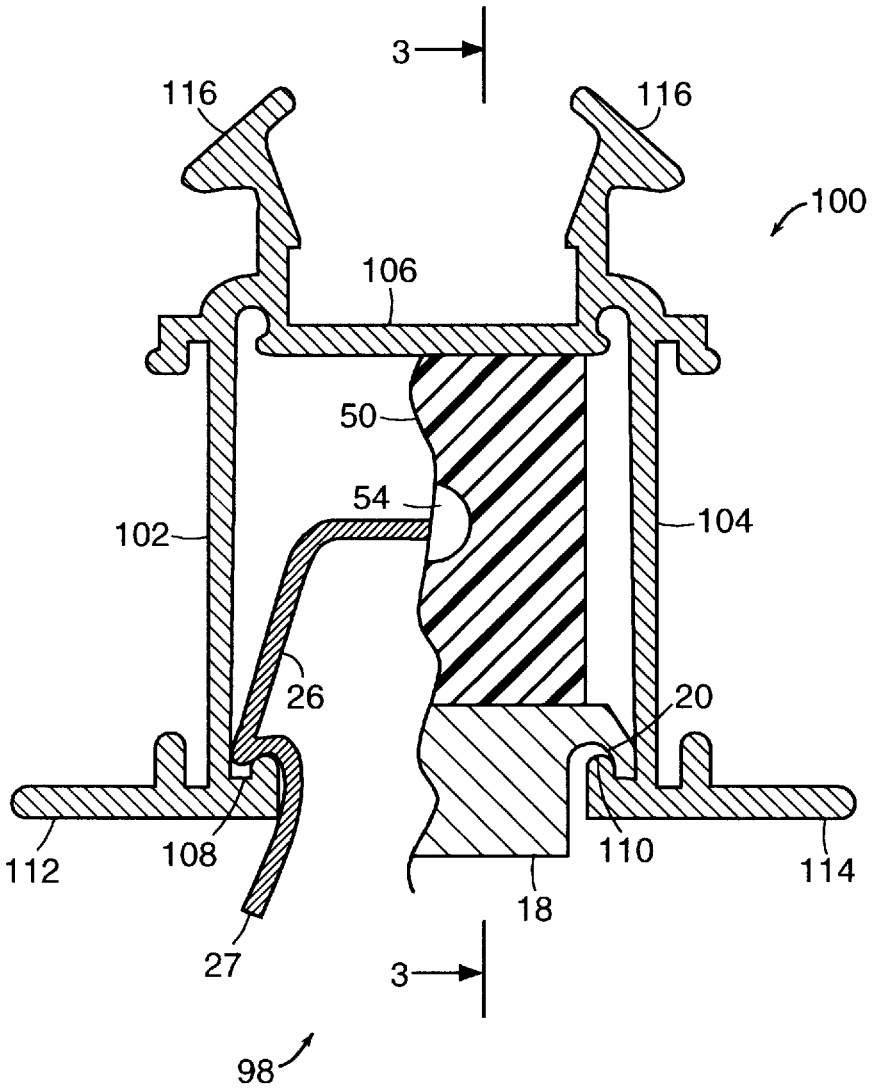
FIG. 4 is a combined cross-sectional view of the power track and a split end view of the top of the hanger and a crosssectional view compression spring in the power track.

The power track 100 in which hanger 10 is mounted is shown in a partial side view in FIG. 3 and in cross-section in FIG. 4. Such power tracks are conventional and are sold by a number of manufacturers, including the assignee of the present application, Boston Metal Products.

As shown particularly in FIG. 4, track 100 has a generally U-shaped channel 98 having a pair of spaced parallel sides 102, 104 and a base 106 extending perpendicularly between sides 102, 104. A pair of hanger support lips 108, 110 are provided along the inner sides of sides 102, 104. Outer edge plates 112, 114 extend outwardly from of sides 102, 104, generally parallel to base 106. For mounting the power track 100 on a suspended ceiling, for example, a pair of longitudinally-extending flexible connector wings 116 project rearwardly from base 106 to contact a longitudinal rail. In other embodiments, particularly in a wall-mounted arrangement, wings 116 may be omitted, so that the track is mounted directly on a surface, such as a wall, with nails or screws extending through track base 106, or with some other mounting means.

Referring particularly to FIGS. 3 and 4, to mount hanger 10 in power track 100, the hanger is aligned with track 100, with tabs 20 and support 22 facing U-shaped channel 98 of track 100. The end of the hanger with tabs 20 is inserted into the channel, and the hanger is rotated about its longitudinal axis so that tabs 20 engage the inner edges of support lips 108, 110 (right side of the split view of FIG. 4). The hanger is then pivotally rotated about tabs 20 until compression spring 26 is snapped into the channel of track 100 (left side of FIG. 4). Thus, portion 18 with tabs 20 serves as a pivoting member, and spring 26 serves as a clamp. To remove a hanger from a power track, the process recited above is reversed after ends 27 of compression spring 26 are squeezed together to disengage spring 26 from support lips 108, 110.

Figure 2:
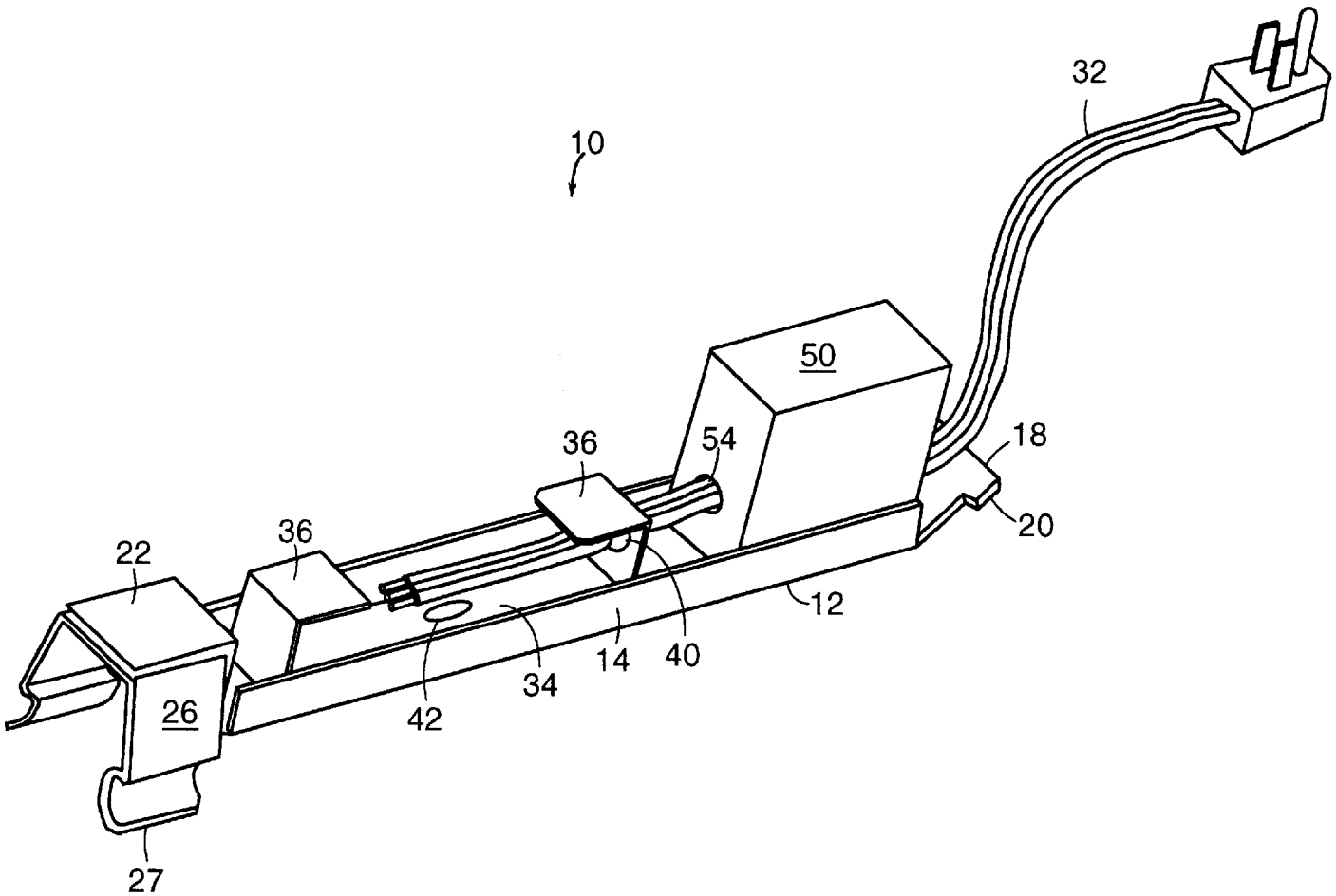
FIG. 2 is a perspective view of the hanger of FIG. 1 as assembled.

Referring particularly to FIGS. 1 and 2, mounted in the channel is a support for a power cord 32 from a light fixture. The support has a base that is coextensive with about half of elongated member 12, and has two integral upturned L-shaped portions 36 at its ends. One of the L-shaped portions has an opening that receives power cord 32 and holds it securely with a grommet 40. The support and the elongated member each have an opening 42 that is aligned so that the power cord extends through member 12 from a fixture to the support.

As shown in FIG. 3, a lighting fixture 62 having a base plate 63 is connected to hanger 10. In practice, the lighting fixture is attached to the hanger with the hanger removed from power track 100, and fixture 62 is wired to power cord 32 of the hanger. Once attached, hanger 10 and light fixture 62 can be placed in, or removed from, power track 100 as a single body.

FIG. 3 shows the hanger and fixture snapped into a power track which is mounted directly on a wall 60 (with a base 106 but without wings 116). As will be apparent, the hanger and fixture can be placed in any desired position along the length of power track 100, or may be removed and placed in a different track.

As is evident, while hanger 10 is held within track 100, hanger 10 can potentially slide longitudinally relative to and within track 100. A fixture can have a weight from about 2–3 pounds up to about 15 pounds. When the hanger is mounted on a wall, the combined weight of the fixture and the hanger can overcome frictional resistance from tabs 20 and clamp 26.

According to a first embodiment of the present invention, a rectangular resilient block 50 is mounted in channel 16, preferably with dual-sided mounting tape 52, near portion 18. Block 50 is typically made of rubber, is about 2 inches square, and is about 1 inch thick. As shown, the thickness of the block is slightly less than the width of channel 16, and its width is such that one flat side of the block contacts, and is slightly compressed by its contact with, base 106 of the power track when the hanger is mounted in the power track. Because of its resiliency, the block creates frictional holding forces between the hanger and the power track. These frictional forces are sufficient to prevent the hanger from sliding down along the power track when typical fixtures are connected to the hanger.

At about the midpoint of the width and the thickness of block 50 is a bore 54 sized to receive the power cord. The bore allows the power cord to extend down the power track, through the block, and away from the hanger. Without the bore, the block, which fills most of the space between member 12 and the power track, would block the passage.

To retrofit the hanger, the block is first attached to the elongated member. The fixture is then coupled to the hanger. Power cord 32 is fed through bore 54, opening 42, and L-shaped portion 32 for connection to the fixture.

Figure 5:
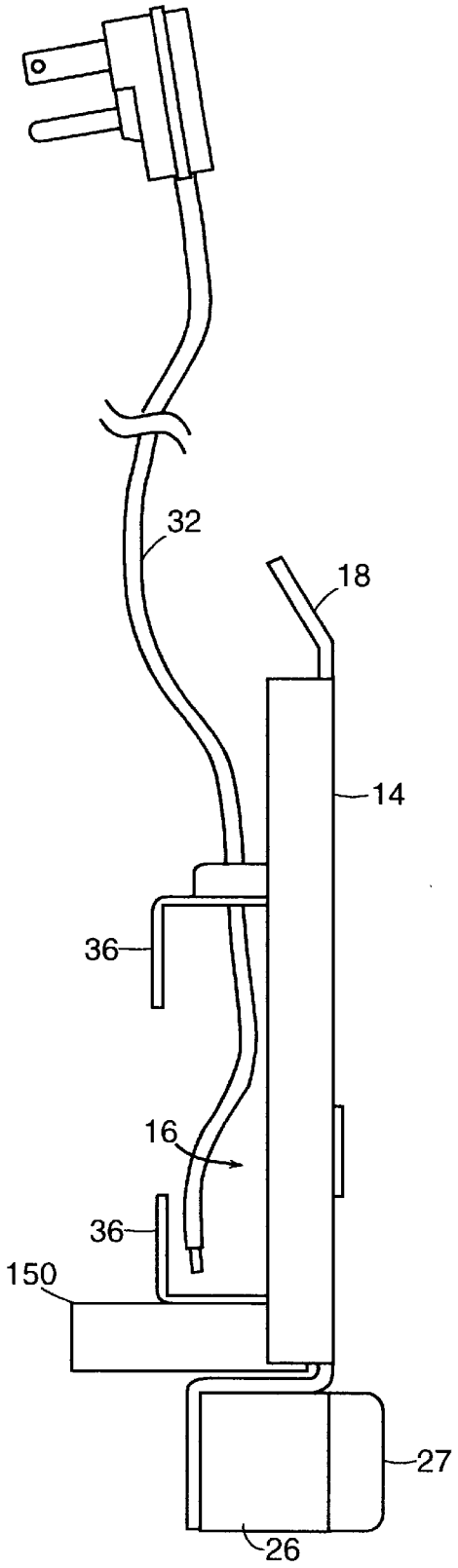
FIG. 5 is a side view of a hanger with a block according to a second embodiment of the present invention.

Referring to FIG. 5, in a second embodiment of the present invention, block 150 is mounted in channel 16 between one of L-shaped portions 36 and spring 26. In this embodiment, because power cord 32 extends away from the end of the hanger with spring 26, block 150 does not block power cord 32 and therefore does not need a central bore for receiving power cord 32. In this embodiment, block 150 has a thickness across the channel of about one inch and a height of about one-half inch. As in the first embodiment, block 150 is preferably mounted with double-sided mounting tape.

While an embodiment of the present invention has been described, other embodiments are within the following claims. The block has been shown in different locations and described with different dimensions, but the location and dimensions can be varied to accommodate different sizes of hangers, power tracks, and fixtures. The block could also have other shapes, such as a trapezoidal shape. The block has been described as being made of rubber, but could also be a suitable plastic or synthetic rubber, provided that it provides sufficient frictional force to prevent the hanger from sliding under the weight of typical fixtures. To attach the block to the hanger, a different type of adhesive, such as an epoxy, or some mechanical attachment, such as a clamp or several pins extending across the channel and through the block can be used. If the block directly contacts the wall rather than the base of the power track, the frictional forces will be between the hanger and the wall.

What is claimed is:

1. A hanger for mounting a fixture to a longitudinally-extending, generally channel-shaped track, the track having a width defined by a pair of spaced sides and a depth defined in part by a rear surface, the hanger comprising:

an elongated body for connection to the fixture, the body having first and second end portions at longitudinally opposite ends of the body, the end portions for engaging the track such that the hanger is adapted to be supported relative to the track in such a way that the hanger is restrained against movement away from the track but is movable relative to the track in a direction generally longitudinally of the track; and a resilient block connected to a side of the body and movable with the body relative to the track, the block adapted to extend from the body towards the rear surface of the track a distance such that the block is in compressive engagement with the rear surface of the track and prevent movement of the hanger longitudinally relative to the track when the hanger is mounted to the track.

2. The hanger of claim 1, the surface of the block that compressively engages the rear surface of the track being generally rectangular and having an area of not less than about 0.5 square inches.

3. The hanger of claim 2, the area being about 1 square inch.

4. A hanger for mounting a fixture to a longitudinally-extending, generally channel-shaped track, the track having a width defined by a pair of spaced sides and a depth defined in part by a rear surface, the hanger comprising:

a body for connection to the fixture, the body having first and second end portions for engaging the track such that the hanger is supported relative to the track so that the hanger is restrained against movement away from the track; and a resilient block connected to a side of the body, the block adapted to extend from the body towards the rear surface of the track a distance such that the block is in compressive engagement with the rear surface of the track and prevent movement of the hanger longitudinally relative to the track when the hanger is mounted to the track, the block being shaped as a rectangular prism.

5. A hanger for mounting a fixture to a longitudinally-extending, generally channel-shaped track, the track having a width defined by a pair of spaced sides and a depth defined in part by a rear surface, the hanger comprising:

a body for connection to the fixture, the body having first and second end portions for engaging the track such that the hanger is supported relative to the track so that the hanger is restrained against movement away from the track; and a resilient block connected to a side of the body, the block adapted to extend from the body towards the rear surface of the track a distance such that the block is in compressive engagement with the rear surface of the track and prevent movement of the hanger longitudinally relative to the track when the hanger is mounted to the track, the block being adhesively connected to the body.

6. A hanger for mounting a fixture to a longitudinally-extending, generally channel-shaped track, the track having a width defined by a pair of spaced sides and a depth defined in part by a rear surface, the hanger comprising:

a body for connection to the fixture, the body having first and second end portions for engaging the track such that the hanger is supported relative to the track so that the hanger is restrained against movement away from the track; and a resilient block affixed to a side of the body, the block adapted to extend from the body towards the rear surface of the track a distance such that the block is in compressive engagement with the rear surface of the track and prevent movement of the hanger longitudinally relative to the track when the hanger is mounted to the track, the block including a bore extending therethrough along a longitudinal direction of the hanger, and including a power cord extending through the bore.

7. In combination, a longitudinally-extending, generally transversely U-shaped cross-sectional support, and a hanger removably attached to the support, the support including a pair of spaced generally parallel side-walls, a base extending generally perpendicularly between the side-walls, and a pair of lips extending generally longitudinally along an interior side of respective ones of the side-walls adjacent edges thereof spaced from the base, the hanger including an elongated central portion elongated in a direction parallel to the longitudinal direction of the support, a first end portion at one end of the central portion and defining a pair of members engaging the lips of the support, and a second end portion spaced longitudinally from the first portion and including a connector releasably engaging the support, the members and the connector being such that the hanger is movable relative to the support in a direction generally longitudinally of the support but is restrained against movement in the directions orthogonal thereto, and a resilient block mounted in compression between facing surfaces of the hanger and the support and movable with the hanger relative to the support, the block preventing movement of the hanger relative to the support in the direction generally longitudinally of the support, at least one surface of the block being in frictional engagement with one of the facing surfaces.

8. The combination of claim 7, the surfaces of the block in compressive engagement with the facing surfaces are generally rectangular and each have an area of not less than about 0.5 square inches.

9. The combination of claim 8, the area being about 1 square inch.

10. The combination of claim 9, the block being shaped as a rectangular prism.

11. The combination of claim 7, the block being adhesively affixed to the hanger.

12. The combination of claim 7, the block including a bore extending longitudinally therethrough, and including a power cord extending through the bore.

13. The combination of claim 7, the block being near the first end portion.

14. The combination of claim 7, the block being near the second end portion.

15. A hanger for connection to a light fixture, the hanger for insertion in an elongated power track mounted on a wall, the power track having a depth, the hanger comprising:

a member for rigid connection to the light fixture and having means for securing the hanger in the power track so that the hanger can move longitudinally along the power track; and a block connected to a side of the member adapted to face the power track and, movable with the member relative to the power track, the block having sufficient size to extend the depth of the power track and being made of a material such that the block is adapted to provide frictional forces between the hanger and the power track so that when the hanger is coupled to the power track the hanger does not move longitudinally along the power track under the weight of the hanger and the light fixture.

16. The hanger of claim 15, the block including rubber.

17. The hanger of claim 15, the block being a rectangular block.

18. The hanger of claim 15, the block being mounted to the member with mounting tape.

19. The hanger of claim 15, further including a power cord, the block having a bore for receiving the power cord therethrough, the power cord for connection to the light fixture.

* * * * *